US006352452B1

(12) United States Patent
Jimenez et al.

(10) Patent No.: US 6,352,452 B1
(45) Date of Patent: Mar. 5, 2002

(54) CONNECTOR MODULE POLARIZATION ASSEMBLY

(75) Inventors: Jorge Jimenez, Bolingbrook, IL (US); Keith Lloyd, Maumelle, AR (US)

(73) Assignee: Molex Incorporated and Tellabs Operations, Inc., Lisle, IL (US)

( * ) Notice: Subject to any disclaimer, the term of this patent is extended or adjusted under 35 U.S.C. 154(b) by 0 days.

(21) Appl. No.: 09/614,786

(22) Filed: Jul. 12, 2000

(51) Int. Cl.[7] ..... H01R 13/64
(52) U.S. Cl. ..... 439/680
(58) Field of Search ..... 439/701, 680, 439/681

(56) References Cited

U.S. PATENT DOCUMENTS

| | | | | |
|---|---|---|---|---|
| 4,884,975 | A | 12/1989 | Pelzl et al. | 439/78 |
| 5,312,276 | A | 5/1994 | Hnatuck et al. | 439/681 |
| 5,385,490 | A | 1/1995 | Demeter et al. | 439/579 |
| 5,772,475 | A | 6/1998 | Lindeberg et al. | 439/701 |

*Primary Examiner*—Neil Abrams
*Assistant Examiner*—P. Dinh
(74) *Attorney, Agent, or Firm*—A. A. Tirva

(57) ABSTRACT

A polarization assembly is disclosed that uses an endcap applied to the end of a block of connectors. The endcap has a depending leg portion and a recess that receives an opposing arm portion of a key member which is insertable into a backplane connector. The endcap leg portion and key member arm portion cooperate to orient the connector block in only one insertion position.

9 Claims, 5 Drawing Sheets

CONNECTOR MODULE POLARIZATION ASSEMBLY

BACKGROUND OF THE INVENTION

The present invention relates generally to connectors and multiple-unit connector assemblies, and more particularly, to a polarization structure for aligning and installing a connector module in a pin header or backplane application in a certain desired orientation while using the least amount of additional space.

In the field of telecommunications and in other electronic fields, cable assemblies are used to connect one electronic device to another. In many instances, the cable assemblies have a plurality of connector modules at their ends, each of which serves to connect a plurality of individual wires to an opposing connector. Such connectors may include a pin header, a backplane connector or the like. It is desirable to connect the individual connector modules together so that they may connected and disconnected from an opposing connector as a single unit, preferably in the form of a single block of connectors, in order to save in time in making the connections, as well as to conserve space.

Additionally, because the connector modules are commonly designed to be installed on various multi-connector pin headers, connector reversal or inverted installation may occur. Therefore, another time-saving feature that is desirable to have on a such connector block is a means for properly orienting connector assemblies during installation into the pin header. This is especially important in order to eliminate any duplicative work of retracing lines to find a reverse-oriented or improperly installed connector.

Structures for attaining these aims are known in the art, and use guide pins disposed in either of the walls of the pin header or on the circuit board itself, but tend to consume valuable space on the circuit board, such as that described in U.S. Pat. No. 4,884,975 issued Dec. 5, 1989 which describes a backplane connector that is separated into distinct bays by a series of individual partitions that fit over contact pins of the header. The partitions have hollow cavities that receive the contact pins and further have slots that receive opposing posts on the connector assemblies to provide a polarizing means for the connector assemblies. However, this design presents time-consuming problems for the installers. For example, in order to mechanically code each plug, each partition has to be modified appropriately.

Another related structure is described in U.S. Pat. No. 5,385,490 issued Jan. 31, 1995 that depicts a modular connector assembly for cable assemblies where each connector module has a molded body with a polarizing rib on one side and polarizing slot on the other side of the module. These ribs and slots cooperate to polarize the wafer modules within a stack, but do not engage and part in a pin header as in the present invention. Additionally, U.S. Pat. No. 5,772,475 issued Jun. 30, 1998 describes a plug-in cable connector in which a plurality of wafers are assembled into a module casing to form a stack of modules. The stacks of modules are interconnected by an Mf blade. In order to space the module casing apart from each other, inserts are provided that may be plugged into the connector and over a row of pins of the pin header. Grooves are also formed in the inserts that act as polarizing means by engaging ribs on the exterior surfaces of the casing.

Although these designs provide a means for polarizing the connector assembly, they are complicated and detailed. A need therefore exists for a simple connector assembly polarizing structure.

The present invention is therefore directed to a novel and unique connector assembly for use with plurality of connector modules, that maximizes the number of usable pins in a pin header and which polarizes the connector assembly with a complementary-shaped spacer key installed in the pin header to assure correct alignment and installation.

SUMMARY OF THE INVENTION

Accordingly, it is a general object of the present invention to provide an improved connector assembly polarization structure that aligns and mandates proper orientation and installation of the connector module.

Another object of the present invention is to provide a spacer key for use with a pin header and which cooperates with an assembly of connector modules to guarantee proper orientation of the connector modules with the pin header.

Yet another object of the present invention is to provide a polarization structure which is variable and adaptable to numerous applications.

Still another object of the presnet invention is to provide a polarization and orienting assembly for use with a plurality of connector modules, wherein the assembly includes an endcap and a key member, the endcap fitting onto one end of the plurality of connector modules, and endcap having a depending leg portion with a width less than that of any associated connector module so as to define a recess along one endface of the plurality of connector modules, the key member being insertable into a backplane connector or pin header and having an arm portion that extends upwardly therefrom alongside the endcap leg portion, the key member arm portion being received within the endcap recess such that the key member arm portion and endcap leg portion cooperate to orient the block of connectors in the pin header in a particular orientation.

The present invention accomplishes these and other objects by way of its novel and unique structure. A connector assembly is provided that includes a plurality of individual connector elements, or modules, each of which includes a connector body portion with a plurality of distinct sides. The connector modules are arranged in a block form by positioning them together in a side-by-side order, such that faces of the connector block collectively define distinct faces of the block of connectors, such as a front face, a rear face and two intervening side faces.

Each connector element includes a plurality of cables extending from a first end of its connector body. Conductive terminals are disposed along an opposing end of the connector body portion and extend through the connector body to connect with the cables. The conductive terminals are accessible along a mating face of the block of connectors that is insertable into a pin header or backplane connector The block of connectors is provided with at least one such endcap having a body portion similar in size and shape as that of the connector elements, and which is held in place with the block of connector elements by way of a retainer member. The endcap is dimensioned and aligned in a side-by-side order with an adjacent connector of the connector block so that faces of the endcap generally match the sides of the connector block.

The endcap is part of a bifurcated assembly with two individual components. The endcap includes one such element, such as a depending leg portion that extends for substantially all of the depth of the connector and the pin header, and having a width that is less than the width of any one of the individual connectors so that a recess is defined by the endcap along the adjacent connector of the connector block. The other polarizing component includes a spacer key that is insertable into the pin header. The pin header, like any backplane connector, includes a plurality of contact pins that may be separated by intervening grounding shields which serve to define transverse channels in the pin header, with each such channel being dimensioned to receive a connector therein. The pins are spaced between the sidewalls of the pin header and arranged between alignment slots formed in the sidewalls to permit engagement by the connector elements with each row of pins to that the proper orientation of the connector assembly during installation is thereby ensured.

The spacer key fits into the pin header and has distinct base and head portions. The base portion includes a plurality of grooves disposed therein that are aligned with the pins of the pin header and actually receive corresponding conductive pins of one row of the pin header. The base portion extends for mostly the entire width of the pin header and a head portion projects upwardly therefrom. The head portion extends adjacent one of the sidewalls of the pin header and it too has a plurality of grooves formed therein that receive corresponding pins of the pin header therein. These grooves permit the spacer key to be fully inserted into the pin header. In a general sense, the spacer key has a structure that is complementary to that of the endcap.

In use, the spacer key of the polarization assembly is installed in the pin header in a row where the pins are "blind" and are intended not to provide a conductive connection. The head portion of the spacer key has a width that approximately corresponds to the width of the endcap recess so that the spacer key head portion and the endcap recess oppose each other when the two elements are properly aligned together and, when engaged together, the spacer key head portion extends into the recess defined by the connector block endcap. The spacer key head portion ensures that the block of connectors will fit into the pin header in only one manner and coresponding to the arrangement of the spacer keys within the pin header.

These and other objects, features and advantages of the present invention will be clearly understood through consideration of the following detailed description.

BRIEF DESCRIPTION OF THE DRAWINGS

In the course of the following detailed description reference will be frequently made to the accompanying drawings in which.

DESCRIPTION OF THE PREFERRED EMBODIMENT

Figure 1:
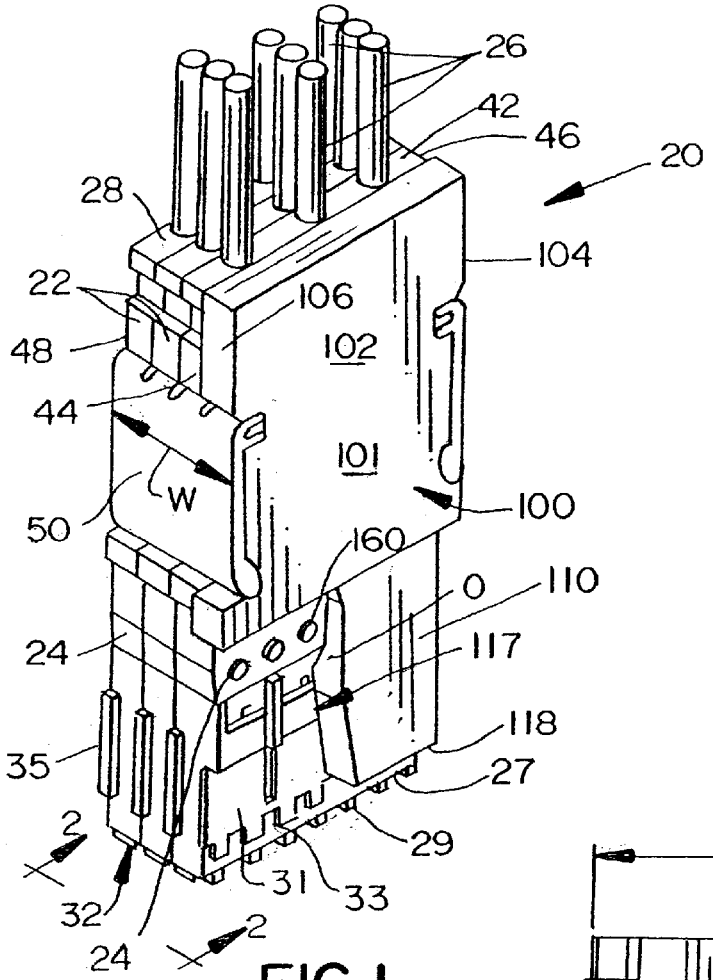
FIG. 1 is a perspective view of a wafer connector assembly and an endcap constructed in accordance with the principles of the present invention in place on one end of the connector assembly.

FIG. 1 illustrates a connector assembly 20 that takes the form of a "block" of individual connector elements, or modules 22. Each connector element 22 has an elongated and relatively thin connector body 24 that is formed from an insulative material. Hence, the name "wafer" connector has been commonly applied to such connector elements 22 in the art. Each connector element 22 has a plurality of conductive elements, such as terminals 25 (shown in phantom) that extend through the connector body 24 in order to provide conductive paths between individual connector cables 26 that are disposed at one end 28 of the connector element 22 and a mating end 32 of the connector element 22. The terminals 25 are held within passages 27 (shown in phantom in FIG. 9) that open along the connector mating face 32 and which may be separated from each other by intervening sidewalls 29.

Each cable 26 may typically contain at least a pair of conductive wires which are terminated to a like number of terminals 25 of the connector body 24. Each such cable may include one or two wires dedicated to carrying electrical signals and another conductor, such as a shield, that is terminated to a conductive shield member 31 that is disposed along a surface 33 thereof. The connector mating end 32 is spaced apart from the cable end 28 of the connector element 22 and is configured so that it is received within an opposing connector member, such as the pin header 34, that is typically mounted to a backplane or circuit board (not shown).

Figure 6:
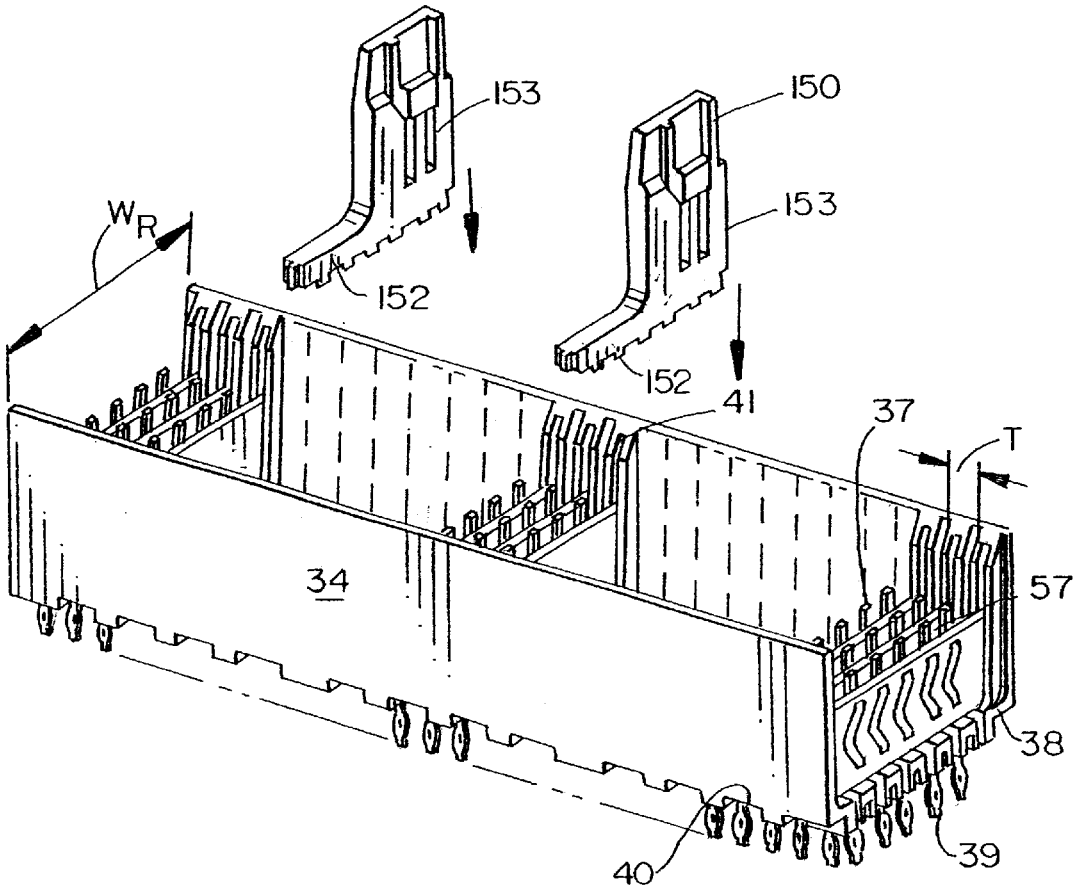
FIG. 6 is an exploded view of a pin header or backplane connector and two spacer keys of the present invention aligned therewith.
Figures 7, 11:
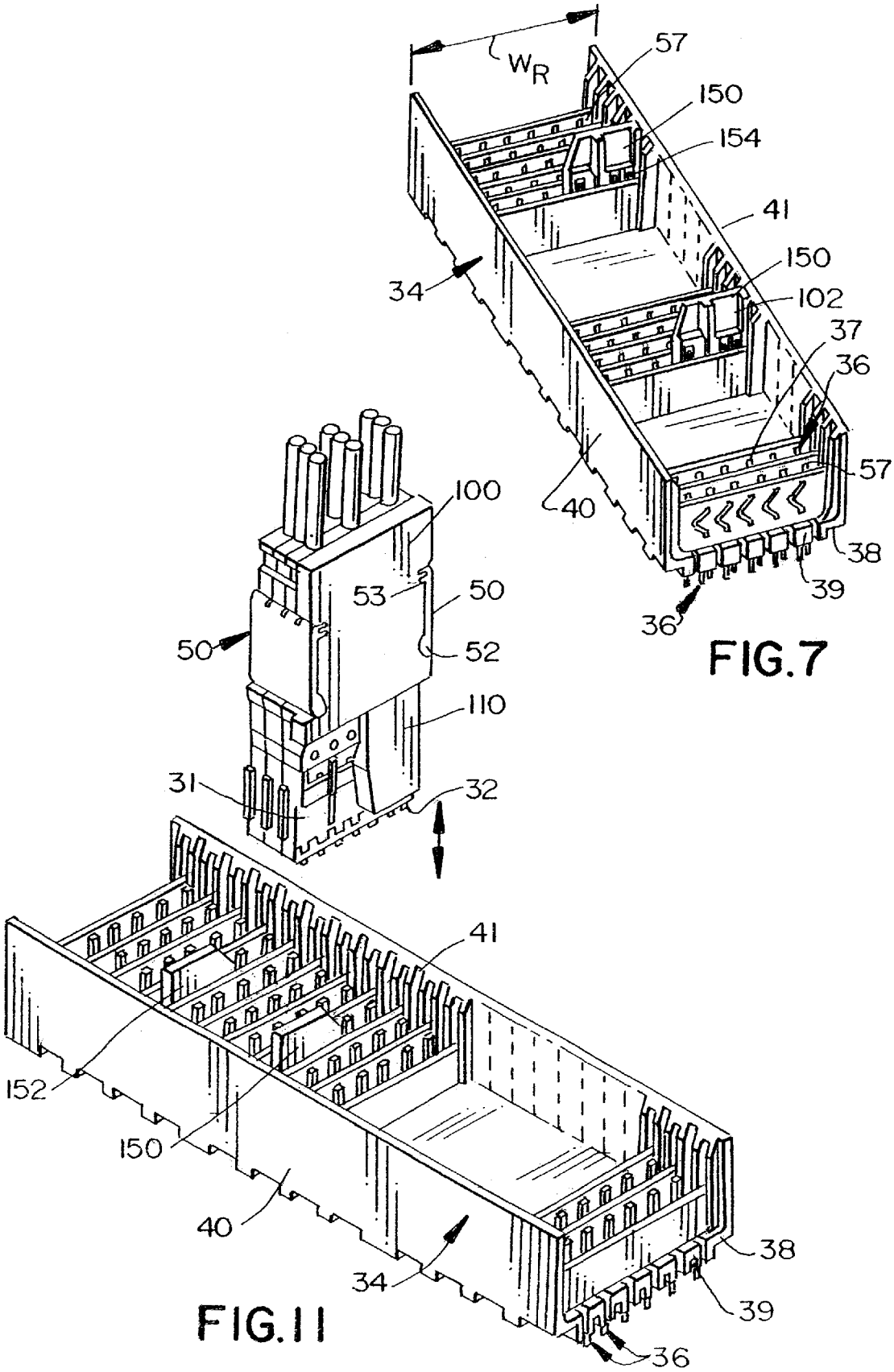
FIG. 7 is an angled perspective view, taken from the top, of the pin header of FIG. 6, with two spacer keys installed in place within the pin header.

The pin header 34, as shown in FIGS. 6 & 7, typically takes the form of a channel and will include a base, or body portion 38 that houses a plurality of conductive terminals 36, illustrated as a plurality of elongated pins, that extend through the base 38 of the pin header. These pins may be considered as having two opposing ends 37, 39. The first ends 37 of these conductive pins 36, are received within corresponding openings in the backplane member or a circuit board, while the other ends 39 thereof are received within openings formed in the mating ends 32 of the connector elements 22 in a manner so that they engage the interior terminals of the connector elements.

Figure 8:
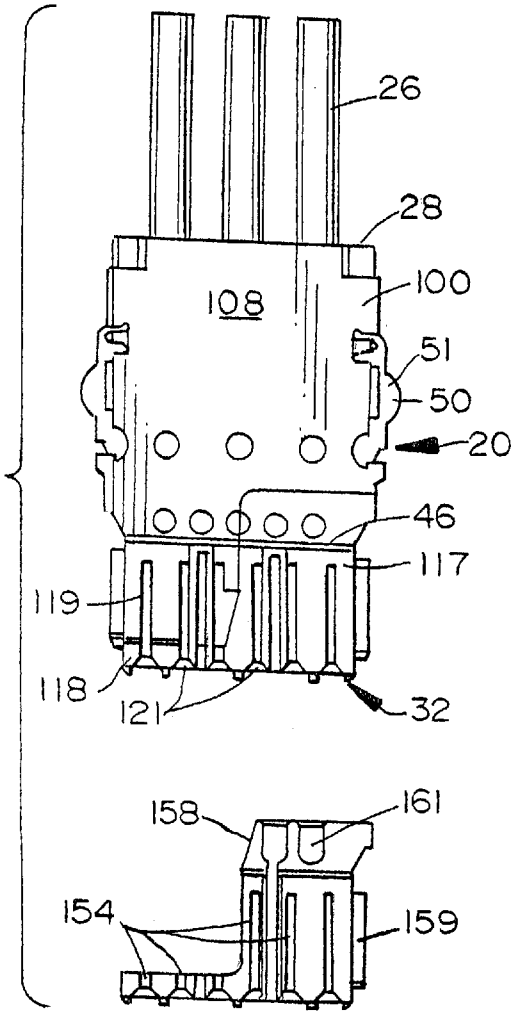
FIG. 8 is a side elevational view, taken from the rear of FIG. 11 of the connector assembly in opposition to a spacer key, prior to their engagement.

Each connector element 22 may be considered as having a number of distinct faces, or edges, with four such sides 42, 44, 46 & 48 being shown in FIGS. 1 and 8. In the Figures, a front face 42 and a rear face 48 are shown as being interconnected by two side (or left and right) faces 44, 46. All of these faces 42, 44, 46 and 48 may be considered as cooperatively defining the connector body portion 24 and as such, they extend between the mating and cable ends 28, 32 of the connector assembly 20.

It is important to retain the connector elements 22 together in alignment as an assembly in the form of a single unit, or block, of connector elements 22 in order to facilitate the insertion thereof into an opposing connector member (pin header) 34 and connection of the connector terminals to the opposing terminals 36 of the pin header 34. The small size of these connector elements 22 and the tolerances involved in making their conductive terminals are some of the reasons why alignment of such connector assemblies 20 is important. When the connector elements 22 are aligned together, the connector assembly 20 is easier to insert into the pin header 34 in a correct orientation without fear of misalignment of the terminals 36 or of the connector elements 22.

A connector retainer member 50 provides a simple and reliable means for engaging and aligning a series of connector elements that may be trimmed to an appropriate size to match the corresponding size of a block 20 of connector elements 22, and which aligns and retains a plurality of the connector elements 22 together as a single mass, or block 20, in a preselected spacing. The detailed construction and function of the retainer member or stiffener 50 has been fully explained and described in U.S. Pat. application Ser. No. 09/515,133 filed Feb. 29, 2000 assigned to the assignee of the present invention, the disclosure of which is hereby incorporated by reference. The body portions 24 of the connector elements 22 and the retainer member 50 have interengaging structure that effectuates the purpose of holding the individual connector elements 22 together as a unified assembly 20 of connector elements 22.

The retainer members 50 have low profiles and each such retainer member 50 includes a body portion 51 with two opposing operative ends 52, 53 that permits them to engage the connector elements 22 along their lengths and the exterior side faces 44, 46, rather than at or along the connector elements mating faces 32 received in the pin header 34. In this regard, the retainer members 50 typically have an alignment end 52 that is received within a corresponding alignment cavity 47 formed in the connector body portion 24, while the opposing retainer member end 53 may have one or more latching members 54 that engage corresponding opposing latching cavities 49 of the connector 22.

The retainer member 50 preferably has a width W (FIG. 1) that may be trimmed to accommodate any size block of connectors. This may be easily accomplished because the retainer member 50 preferably has a pair of engagement ends 52, 53 for each corresponding connector element 22 of the entire connector assembly 20. In this manner, the retainer member 50 not only stiffens the block of connector elements 22, but also aligns each of the connector 22 elements within the overall connector block 20. The retainer members 50 are low profile and are positioned on the connector elements 22 at a location well above the sidewalls 40, 41 of the pin header 34, thereby not requiring modification of the opposing connector 34 as in the prior art.

The pin header 34, as illustrated, preferably includes two sidewalls 40, 41 that define the channel portion of the connector 34 and which accommodate the connector elements 22, either individually, or as a combined block of connector elements 22. In this regard, the pin header sidewalls 39, 41 have corresponding slots 56 that receive complementary ribs 35 that are formed on the side faces 44, 46 of each connector element 22. These ribs 35 fit within the slots 56 and assist in locating the connector element 22 within the channel portion of the pin header 34. This construction maintains the original footprint of the pin header 34 on the circuit board without sacrificing additional space thereon to support the connector block. The pin header 34, as illustrated best in FIGS. 6 & 7, includes a plurality of rows 57 of pin terminals 36 that extend transversely between the sidewalls 40, 41. These rows 57 and their included terminals 36 may be further separated by intervening conductive shields 58. Each row 57 has a thickness T (FIG. 6) that approximately matches a corresponding thickness T of the connector elements 22.

Figure 3:
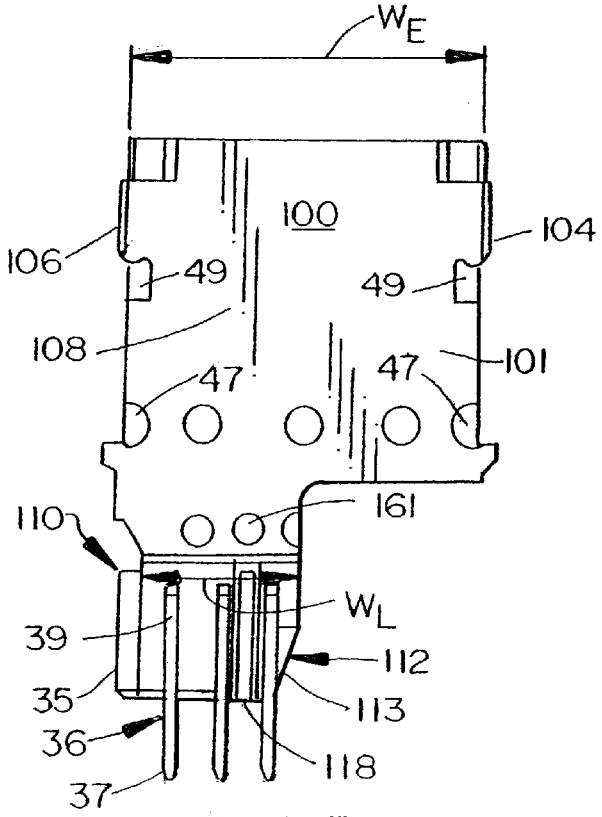
FIG. 3 is a rear elevational view of the connector assembly endcap.

As shown in FIG. 3, the endcap 100 has a body portion 101 that has substantially the same dimensions as the connector body portion 24. The endcap 100 has a corresponding number of distinct faces 102, 104, 106 and 108, which respectively define a front face 102, a rear face 108 and two intervening side faces 104, 106 of the endcap 100. The endcap 100 is provided with a depending leg portion 110 that defines one polarizing component of the present invention, and is shown as extending downward from the endcap body portion 101, although it will be understood that the terms "dow" or "downward" are relative in their orientation are refer to the direction of insertion of the connector assembly 20 into the pin header 34. The endcap leg portion 110 may include, preferably along a vertical extent thereof, a beveled edge 112 that may form a lead-in surface 113 that generally opposes the channel portion of the pin header 34.

The endcap 100 is intended to function as its name implies, that is to form n end to the connector assembly 20. Accordingly, it is preferred that the endcap 100 have an overall thickness T that does not exceed any thickness T of either any corresponding connector element 22 or any of the coresponding insertion slots 56 formed in the pin header 34. The endcap 100 may therefore be formed with alignment and latching cavities 47, 49 as shown in FIG. 3 to accommodate and engage retainer members 50. The endcap 100 may also include a rib 120 along one of its faces 106 to assist in orienting it within a row 57 of the pin header 24.

Figure 9:
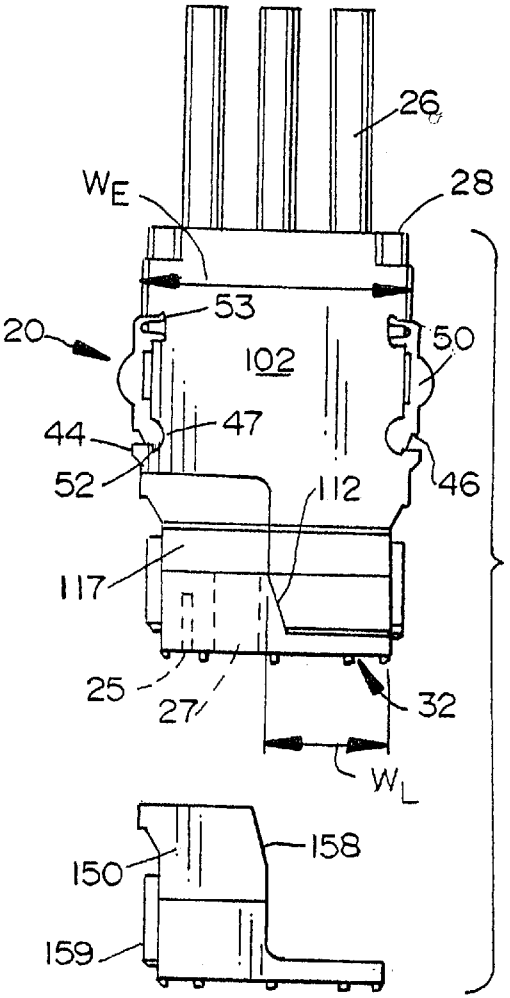
FIG. 9 is a similar view as FIG. 8, but taken from the front of the FIG. 11.

In order to properly function as a polarizing component, the endcap leg portion 110 has a width WL that is less that the width WE of the endcap 100 itself and particularly, its body portion 101. This relationship serves to define a recess 117 along the endface of a connector assembly 20, such as is shown in FIGS. 1 or 9. This recess 117 has a preselected height H that preferably matches a corresponding height of the endcap leg portion 110. As stated above, the width WE of the end cap 100 should always be greater than the width WL of the element 110, and as illustrated in the Figures, the width WL of the endcap leg portion 110 will be about one-half the width WR of the rows 57 of the pin header 34. This is to provide the endcap leg portion 110 with sufficient structure to function as a polarizing component. It is contemplated that other widths may be used to achieve the same results, such as the endcap leg portion 110 having a width of about no less than one-fourth of the width WR of the pin header rows 57.

The endcap leg portion 110 approximately extends alongside the mating face 32 of an adjacent connector element 22 and also extends into an opposing row 57 of the pin header 34. The row 57 that receives the endcap leg portion 110 may or may not have pin terminals 36 disposed therein. In instances where pin terminals 36 are present, the endcap leg portion 110 is provided with a series of slots 119 that open up to the mating end 118 of the end cap 100 and which are arranged in a spacing that corresponds to the spacing between the pin terminals 36. These slots 119 have a depth that is equal to or greater than the height of the pin terminals 36 projecting above the base portion 38 of the pin header 34 and they may include angled lead-in surfaces 121 to assist in guiding the pin terminals 36 into the slots 119.

The present invention uses a second polarizing component which takes the form of a separate spacer key 150, as shown in FIGS. 6 & 7. The spacer key 150 includes a base portion 152 and an arm portion projection 153 that extends upwardly from the base portion 152. The endcap base portions 152 is substantially smaller in height than the key member arm portion 153. It is preferred that the height of the arm portion 153 be at least four times the height of the base portion 152. The base portion 152 also preferably has a width that is comparable to the width WR of the pin header row 57, and it further includes a plurality of slots, or grooves 154, formed therein which receive the pin terminals 36, when the spacer key 150 is inserted into a pin header 34. These slots 154 may extend within both the base and arm portions 152, 153 while passing completely through the base portion 152, but being contained in the arm portion 153. The arm portion 153 of the spacer key 150 may also have a beveled, or slanted edge 158 that is approximately complementary to the edge 112 of the endcap 100. These two edges 112, 158 cooperate in guiding the connector assembly 20 into place within the pin header 34. The spacer key 150 may also include a rib 159 (FIG. 8) that is received with a slot 56 of the pin header 34.

Figure 2:
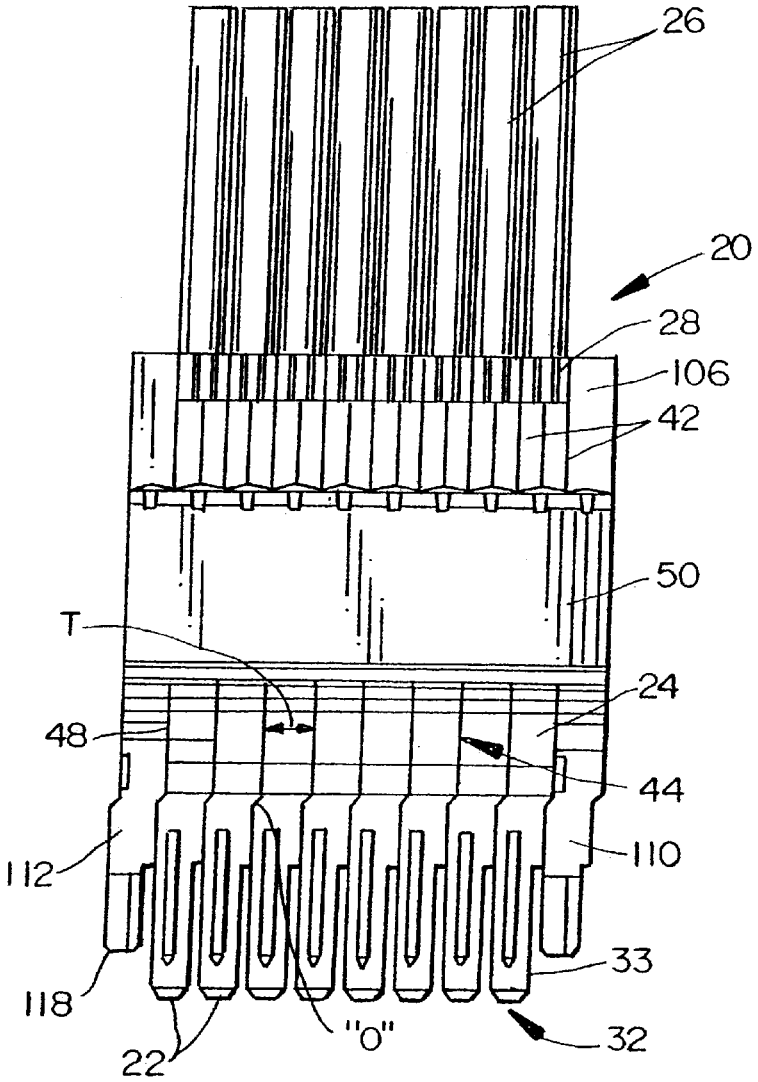
FIG. 2 is a side elevational view of the connector assembly of FIG. 1, taken along lines 2—2 thereof.
Figure 4:
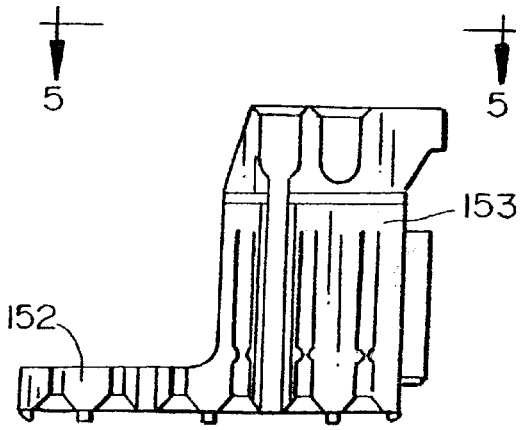
FIG. 4 is a rear elevational view of the spacer key.
Figure 5:
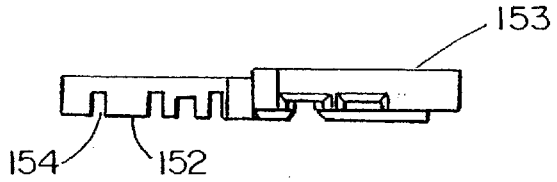
FIG. 5 is a top view of the spacer key of FIG. 4, taken along lines 5—5 thereof.
Figure 10:
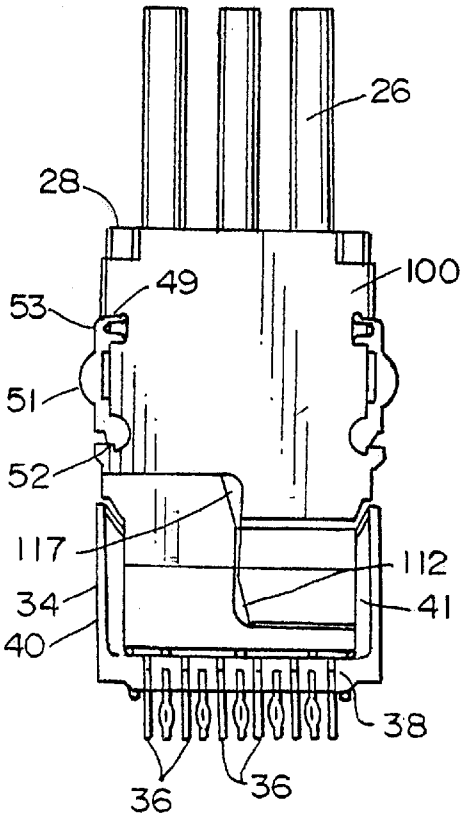
FIG. 10 is an elevational view illustrating the spacer key and connector assembly inserted into a pin header connector; and, FIG. 11 is a perspective view of the spacer keys installed in the pin header prior to engagement with the connector assembly of FIG. 1.

As illustrated in FIGS. 8–10, the width of the spacer key arm portion 150 is approximately the same as the width of the recess 117 defined in the endcap 100. This relationship may also be expressed as the width of the spacer key arm portion 153 is approximately equal to the difference of the width WR of a pin header row 57 and the width WE of the endcap leg portion 110 and vice-versa. In this manner, the spacer key arm portion 153 is received within the recess 117 defined on the connector assembly by the endcap leg portion 110. The thickness of the spacer key 150 is desired to be the same as the thickness of the endcap 100. As shown in FIG. 2, the endcap 100 and the connector elements 22 each have their lower portions slightly offset, such as at "O". The spacer key 150 also has such an offset. Each of the spacer key 150 and the endcap 100 may be provided with recesses 160 that receive corresponding opposing projections 161 formed on the connector elements 22 in order to initially position the endcaps 100 on a block of connectors 20. (FIGS. 1 & 8.)

In operation, the endcaps 100 are applied to opposite ends of a block of connector elements 22 and are retained together therewith by retainer members 50. Spacer keys 150 are placed in corresponding rows 57 of the pin header 34 at locations that correspond to the endcaps 100 of the connector assembly 20. The spacer key arm portions 153 will project upwardly in the channel portion of the pin header 34 and will be received only in the recesses 117 defined on the ends of the connector assembly 20 by the endcaps 100, so that the spacer key arm portion 153 and the endcap leg portion 110 somewhat abut each other, thereby orienting the connector assembly 20 for proper insertion into the pin header 34.

While the preferred embodiment of the invention have been shown and described, it will be apparent to those skilled in the art that changes and modifications may be made therein without departing from the spirit of the invention, the scope of which is defined by the appended claims

We claim:

1. A connector assembly orienting key for insertion into a backplane connector, the backplane connector having rows of contact pins arranged lengthwise of said backplane connector, said backplane connector including a pair of sidewalls defining a central channel of said backplane connector, the backplane connector channel being configured to accept a plurality of connector elements in the form of a connector assembly, comprising:

a key member having a base portion and a arm portion extending from the base portion, said base portion having a first width that corresponds to a distance between said backplane connector sidewalls so that said key member base portion may be freely insertable into said backplane connector, the key member arm portion having a second width that is less than said first width whereby said key member arm portion extends only partly between said backplane connector sidewalls when said key member is inserted into said backplane connector, said difference in said first and second widths defining a notch for receiving a corresponding opposing portion of said connector assembly to thereby orient said connector assembly in a particular orientation with respect to said backplane connector.

2. The connector assembly orienting key of claim 1, wherein key member has a plurality of slots formed therein that receive said contact pins of said backplane connector when said key member is inserted into said backplane connector.

3. The connector assembly orienting key of claim 2, wherein said slots extend completely through said key member base portion and partially through said key member arm portion when said key member is inserted into said backplane connector.

4. The connector assembly orienting key of claim 1, wherein said key member arm portion includes a lead-in surface for guiding a portion of said connector assembly into said backplane connector.

5. The connector assembly orienting key of claim 4, wherein said lead-in surface includes a slanted surface.

6. The connector assembly orienting key of claim 1, wherein said key member base and arm portions have different heights, said key member arm portion being substantially higher than said key member base portion.

7. The connector assembly orienting key of claim 6, wherein said key member arm portion extends above said key member base portions a distance equal to at least four times a height of said key member base portion.

8. The connector assembly orienting key of claim 1, wherein said key member has an L-shaped configuration.

9. An assembly for orienting a block of connectors for installation in a pin header, the pin header having a plurality of rows of contact pins spaced lengthwise along the pin header, the contact pins being spaced apart widthwise between a pair of opposing sidewalls of said pin header, the assembly comprising:

a connector assembly including a plurality of individual connector elements, each of the connector elements having a similar connector body, at least one endcap having a size similar to at least one of said connector elements, each of the connector elements and said endcap having aligned cavities for engagement by a retainer that holds said connector elements and said endcap together as a block;

said endcap having at least one depending leg portion that extends therefrom toward a common mating edge of said block of connectors, said endcap leg portion having a width less than a corresponding width of an adjacent connector element to thereby define a recess on an end of said connector block; and, a key member for orienting said block of connectors in a preselected orientation within said pin header, the key member including a base portion for engaging said contact pins and an extending arm portion, having a width approximately equal to that of said recess, whereby said endcap forms a recess on one end of said connector assembly that receives said key member arm portion therein to orient said connector assembly in only one orientation.

* * * * *